US006472592B1

(12) United States Patent
Arizumi

(10) Patent No.: US 6,472,592 B1
(45) Date of Patent: Oct. 29, 2002

(54) APPARATUS FOR AND METHOD OF ADDING SOUND SIGNAL IN SYSTEM HAVING LIMITED NUMBER OF SOUND GENERATORS

(75) Inventor: Masako Arizumi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/391,386

(22) Filed: Sep. 8, 1999

(30) Foreign Application Priority Data

May 11, 1999 (JP) ..... 11-129890

(51) Int. Cl.[7] ..... G10H 1/22; G10H 1/42

(52) U.S. Cl. ..... 84/656; 84/667; 84/DIG. 2; 84/DIG. 12

(58) Field of Search ..... 84/611, 612, 618, 84/635, 636, 651, 652, 656, 667, 668, 681, 713, 714, DIG. 2, DIG. 12

(56) References Cited

U.S. PATENT DOCUMENTS 4,481,851 A * 11/1984 Swain et al. ..... 84/DIG. 2
4,570,520 A * 2/1986 Deutsch et al. ..... 84/DIG. 2
5,009,147 A * 4/1991 Yamamori ..... 84/618
5,042,355 A * 8/1991 Kozuki ..... 84/618
5,095,800 A * 3/1992 Matsuda ..... 84/618
5,159,144 A * 10/1992 Fujisawa et al. ..... 84/656
5,286,910 A * 2/1994 Hasebe ..... 84/618 X
5,315,059 A * 5/1994 Saito ..... 84/656
5,380,949 A * 1/1995 Matsuda ..... 84/618

FOREIGN PATENT DOCUMENTS

JP 64-76098 3/1989
JP 5-35300 2/1993
JP 5-122094 5/1993

* cited by examiner

*Primary Examiner*—Stanley J. Witkowski
(74) *Attorney, Agent, or Firm*—McDermott, Will & Emery

(57) ABSTRACT

In the sound signal adding apparatus in which there is a limitation on the number of reproducible sound sources, a remaining reproduction time determining section and a sound data attenuation controlling section are provided. The remaining reproduction time determining section checks, when sound data is to be added and reproduced, the remaining reproduction time of the sound data current being reproduced and detects a sound data having least reproduction time remaining. While the sound data attenuation controlling section reduces the output level of the sound signal corresponding to the sound data detected by the remaining reproduction time determining section.

4 Claims, 3 Drawing Sheets

PRIOR ART

APPARATUS FOR AND METHOD OF ADDING SOUND SIGNAL IN SYSTEM HAVING LIMITED NUMBER OF SOUND GENERATORS

FIELD OF THE INVENTION

The present invention relates to a sound signal adding apparatus for reproducing sound from a sound data. More particularly this invention relates to a sound signal adding apparatus in which there is a limitation on the number of reproducible sound generators as well as to a method of reproduction sound.

BACKGROUND OF THE INVENTION

Description is made hereinafter for a sound signal adding apparatus based on the conventional technology. FIG. 3 is a view showing a configuration of the sound signal adding apparatus based on the conventional technology. As shown in FIG. 3, designated at the reference numeral 1 is a sound data storing section comprising a semiconductor storage device such as a ROM for storing therein a plurality of sound data (1) to (M). Designated at 5 is a sound data selector for selecting the sound data under a microcomputer control. Designated at 2 is a data demodulating section (which comprises a first data demodulating section 2*a*, a second data demodulating section 2*b*, and a third data demodulating section 2*c*) for receiving the plurality of sound data from the sound data storing section 1 and demodulating each of the sound data for reproduction. Designated at 4 is a data adding section for receiving the demodulated data outputted from the data demodulating section 2 and adding each of the signals to output the added signal. The maximum number of reproducible sound generators is different depending upon the type of the device. However, for convenience in description, it is assumed herein that the maximum number of sound generators is three in this example based on the conventional technology. In other words, the maximum selectable number of sound generators in the sound data selector 5 is three.

The conventional type of sound signal adding apparatus configured as described above controls the sound data selector 5 during sound reproduction in such a way that the number of sound generators does not exceed the maximum reproducible number of sound generators at any time. Therefore, when a number of sound generators in current reproduction is three, and if an additional sound generator different from the sound generators which are being currently reproduced is to be reproduced, for example, any one of the sound generators which are being currently reproduced is stopped and the newly added sound generator is reproduced.

Furthermore, when a so called chain reproduction is to be performed in which a particular rhythm pattern to be reproduced using a plurality of sound generators is linked to a rhythm pattern different therefrom, then in the conventional type of sound signal adding apparatus the latter rhythm pattern is reproduced after the former rhythm pattern is completely finished.

In the conventional type of sound signal adding apparatus, however, when a number of sound generators which are being currently reproduced is three and when an additional sound generator different from these sound generators is to be reproduced then a non-linear noise due to interruption of the sound signals may occur which causes quality of sound to be degraded.

In addition, when the chain reproduction is to be performed in the conventional type of sound signal adding apparatus, reproduction of a rhythm pattern is restricted due to the maximum number of reproducible sound sources. In other words, a next rhythm pattern can not be reproduced until the rhythm pattern in current reproduction is finished, so that even if a user wants to immediately reproduce a next rhythm pattern, for example, if reproduction of any one of the sound generators which have been linked for the rhythm pattern in execution is not finished, the next rhythm pattern can not be reproduced until the rhythm pattern is completely finished.

SUMMARY OF THE INVENTION

It is an object of the present invention to obtain, for the purpose of solving the problems described above, a sound signal adding apparatus which can prevent occurrence of nonlinear noise due to interruption of sound signals and can immediately reproduce, for chain reproduction, the next rhythm pattern without waiting for a rhythm pattern in current reproduction to be finished, as well as to obtain a method of reproduction of sound.

In the present invention, a sound data searching unit identifies a sound signal having the least remaining reproduction time, and an output level control unit mutes this signal. Therefore, occurrence of non-linear noise due to interruption of sound signals can be suppressed and hence quality of sound can largely be improved.

In the present invention, the sound data searching unit and the output level control unit are utilized even when the chain reproduction is performed. Therefore, a next rhythm pattern can immediately be reproduced before reproduction of all the sound generators for a rhythm pattern in execution is finished, so that it is possible to solve the problem in the conventional technology that a next rhythm pattern can not be reproduced until a rhythm pattern in execution is completely finished.

In the present invention, a. sound signal having a least reproduction remaining time is identified in the sound data searching step, and this sound signal is muted in an output level control step. Therefore, occurrence of non-linear noise due to interruption of sound signals can be suppressed and hence quality of sound can largely be improved.

In the present invention, the sound data searching step and the output level control step are utilized even when the chain reproduction is performed. Therefore, a next rhythm pattern can immediately be reproduced before reproduction of all the sound sources for a rhythm pattern in execution is finished, so that it is possible to solve the problem in the conventional technology that a next rhythm pattern can not be reproduced until a rhythm pattern in execution is completely finished.

Other objects and features of this invention will become understood from the following description with reference to the accompanying drawings.

DESCRIPTION OF THE PREFERRED EMBODIMENTS

Detailed description is made hereinafter for the preferred embodiment of the sound signal adding device according to the present invention with reference to the attached drawings. It should be noted that the present invention is not limited by the embodiment.

Figure 1:
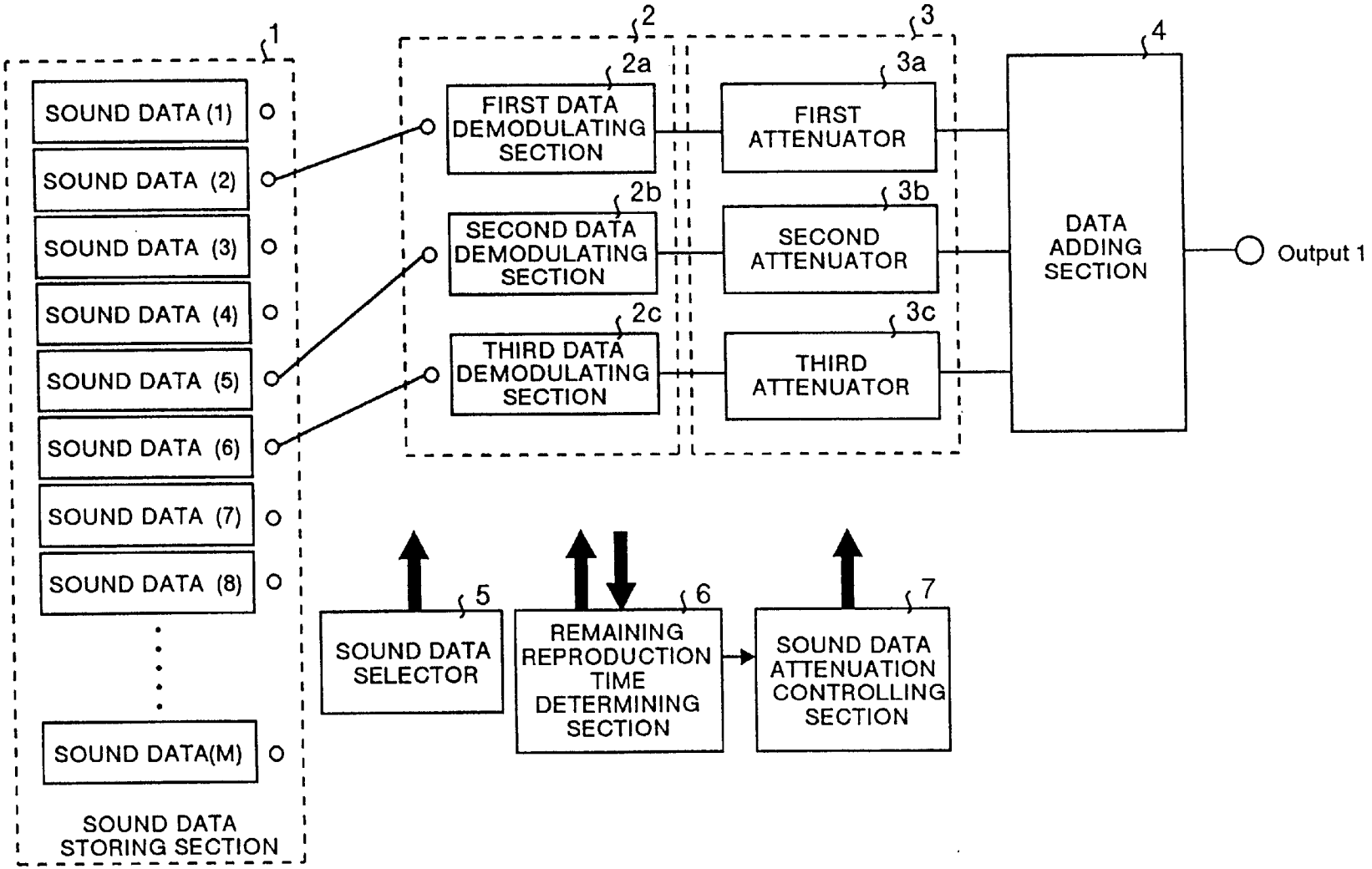
FIG. 1 is a view showing configuration of a sound signal adding apparatus according to the present invention.

FIG. 1 is a view showing configuration of the sound signal adding device according to the present invention. As shown in FIG. 1, designated at the reference numeral 1 is a sound data storing section comprising a semiconductor storage device such as a ROM. Designated at the reference numeral 5 is a sound data selector. Designated at the reference numeral 2 a is data demodulating section (which comprises a first data demodulating section 2*a*, a second data demodulating section 2*b*, and a third data demodulating section 2*c*), Designated at the reference numeral 6 is a remaining reproduction time determining section. Designated at the reference numeral 3 is an attenuator (which comprises a first attenuator 3*a*, a second attenuator 3*b*, and a third attenuator 3*c*) . Designated at the reference numeral 4 is a data adding section. The maximum number of reproducible sound generators is different depending upon the type of the device. However, for convenience in description,-it is assumed herein that the maximum number of sound generators is three in this embodiment. In other words, the maximum selectable number of sound generators in the sound data selector 5 is three.

Operations of the above mentioned sound signal adding apparatus are described here. At first, a plurality of sound data, namely sound data (1) to (M) shown in the figure are previously stored in the sound data storing section 1. Here M is any arbitrary integer. When a sound generator is to be reproduced in this status, the sound data selector 5 selects one of the sound data from the sound data storing section 1 under a microcomputer control and provides controls over connection thereof to the data demodulating section 2.

Each of the first data demodulating section 2*a*, the second data demodulating section 2*b*, and the third data demodulating section 2*c* having received one sound data respectively demodulates the sound data to reproduce the sound. Ordinarily, the reproduced sound signal is transmitted to the data adding section 4 via the attenuator 3, and the data adding section 4 adds the received sound signals and outputs the added signal from the terminal Output 1.

Operations during reproduction of the maximum reproducible number of sound generators are described here. In other words, operations when an additional sound data which is different from the currently being reproduced three sound data is to be reproduced are explained.

When a number of sound data currently being reproducted is three and if additional sound data is to be reproduced, the sound signal adding apparatus according to the present invention works as follows. The apparatus determines in the remaining reproduction time determining section 6 how much reproduction time is remaining in the sound data currently being reproduced, and searches a sound data for which the remaining time is least.

Then, a sound data attenuation controlling section 7 which receives the result of detection from the remaining reproduction time determining section 6 provides controls over the attenuator 3 which receives the sound data. The attenuator 3 is so controlled that the attenuator 3 reduces the output level of the sound signal of the sound data for which the remaining time is least step by step (this operation is described "soft mute" hereinafter). Namely, the sound data attenuation controlling section 7 selects any one of the first attenuator 3*a*, the second attenuator 3*b*, or the third attenuator 3*c* in the attenuator 3 to control the attenuator 3.

After the soft mute is complete, the sound data selector 5 selects the additional sound data and connects this selected sound data to the data demodulating section which is reproducing the sound signal as an object for soft mute. The data adding section 4 receives, similarly to the ordinary operation described above, the signal outputted from the attenuator 3, and adds the signals and outputs the added signal from the terminal Output 1.

Figure 2:
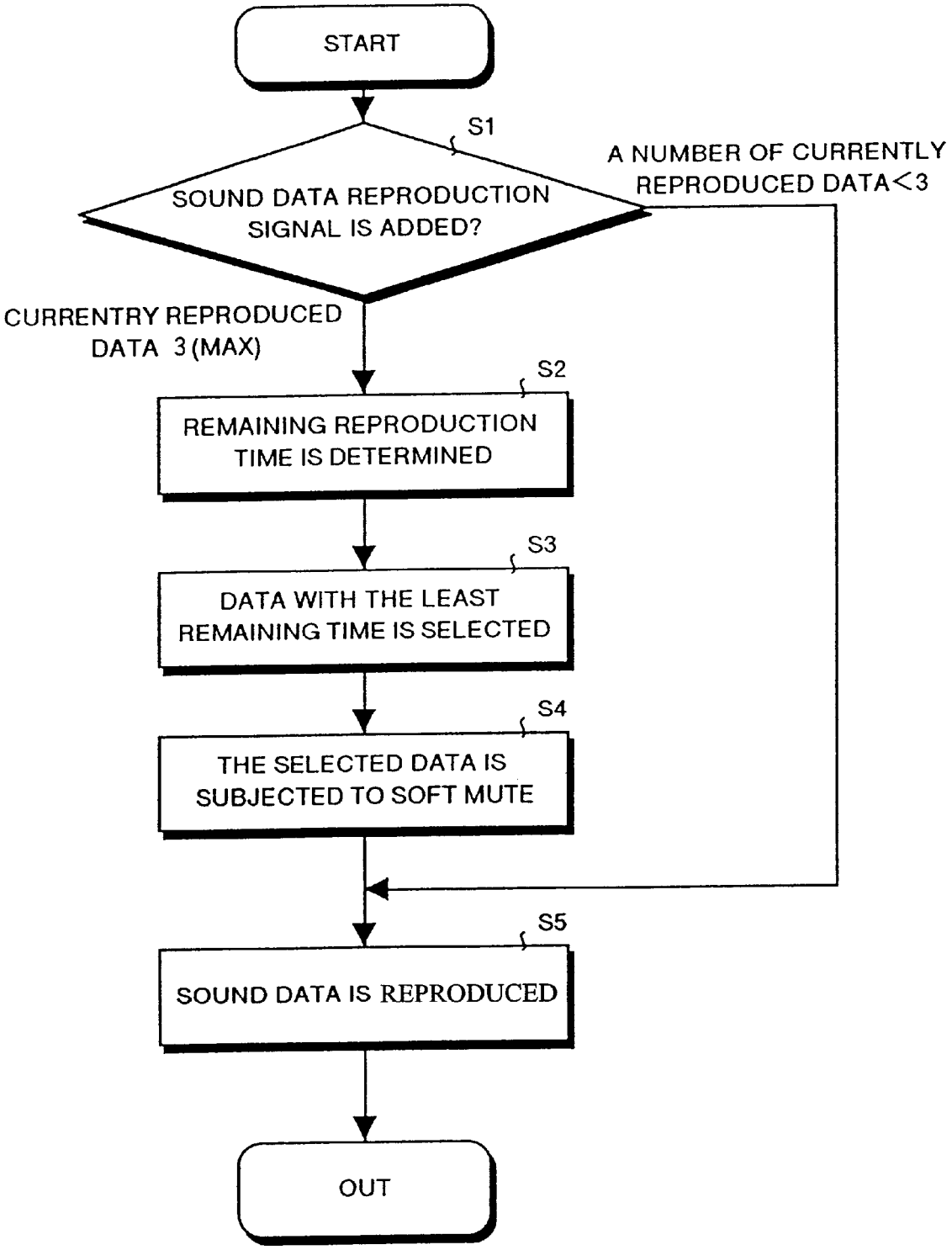
FIG. 2 is a flow chart of a sound source reproduction method according to the present invention.
Figure 3:
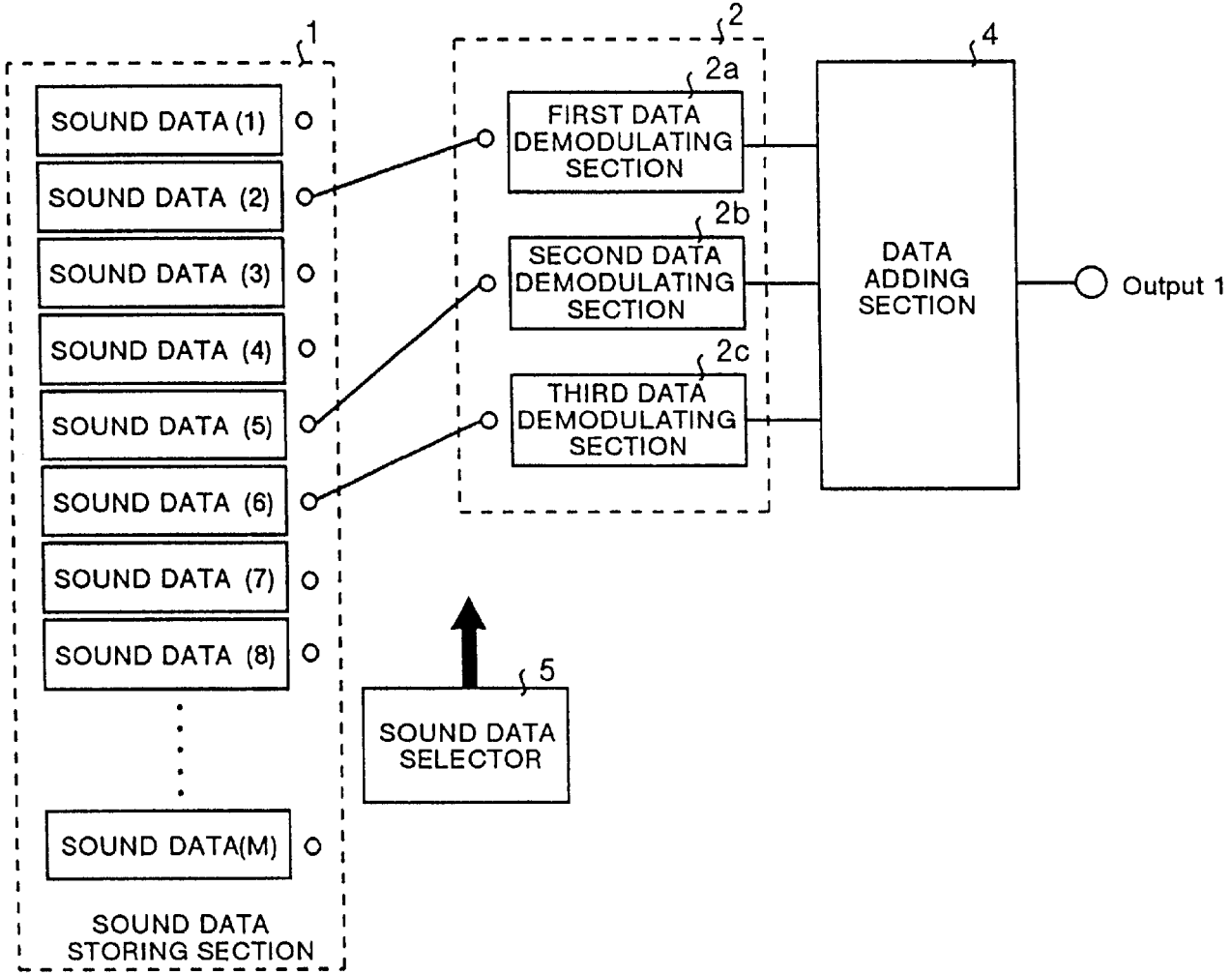
FIG. 3 is a view showing configuration of a sound signal adding apparatus based on the conventional technology.

FIG. 2 is a flow chart showing the steps involved in the sound reproduction method according to the present invention. The sound reproduction method is explained by referring to this FIG. 2.

At first, the sound signal adding apparatus checks, when sound data is added, whether a number of sound source data in current reproduction is the maximum number of sound sources or not (step S1). For example, when the number is less than the maximum number of reproducible sound generators (step S1, the number of currently reproduced data<3), the sound signal adding apparatus reproduces the additional sound data using a data demodulating section which is not currently reproducing (step S5). On the other hand, when the number is equal to the maximum number of reproducible sound generators (step S1, the number of currently reproduced data=3), the sound signal adding apparatus detects how much time is remaining for the sound signal current being reproduced (step S2) and identifies a sound data having the least remaining time (step S3). Then, the sound signal adding apparatus subjects the sound signal corresponding to the identified sound data to soft mute (step S4), and reproduces the additional sound source data using the data demodulating section from which the muted sound signal was being outputted (step S5).

As described above, in this embodiment, a sound signal having the least remaining time is identified, and this signal is muted. Therefore, non-linear noise due to interruption of the sound signal does not occur so that the quality of the sound is largely improved as compared to the quality of sound in the conventional technology.

Furthermore, in this embodiment, the above mentioned soft mute function is also applied when performing the so-called chain reproduction. Because the soft mute function is used, for example, even when a user wants to immediately reproduce the next rhythm pattern before reproduction of all the sound generators for a rhythm pattern in execution is finished, the next rhythm pattern can be reproduced whatever the rhythm pattern in execution may be. Therefore, the problem in the conventional technology such that the nest rhythm pattern can not be reproduced until the rhythm pattern in execution is completely finished can be resolved. By executing a soft mute to the sound data having less remaining reproduction time, next sound data (rhythm pattern) can successively reproduced and sound can be reproduced without lowering the sound quality in the same manner as described above.

As described above, in the present invention, the sound data searching unit identifies a sound signal having the least reproduction remaining time, and the output level control unit mutes this sound signal. Therefore, occurrence of non-linear noise due to interruption of sound signals can be suppressed and hence quality of sound can largely be improved.

In the present invention, the sound data searching unit and the output level control unit are utilized even when the chain reproduction is performed. Therefore, a next rhythm pattern can immediately be reproduced before reproduction of all the sound generators for a rhythm pattern in execution is finished, so that it is possible to solve the problem in the conventional technology that a next rhythm pattern can not be reproduced until a rhythm pattern in execution is completely finished.

In the present invention, a sound signal having a least reproduction remaining time is identified in the sound data searching step, and this sound signal is muted in an output level control step. Therefore, occurrence of non-linear noise due to interruption of sound signals- can be suppressed and hence quality of sound can largely be improved.

In the present invention, the sound data searching step and the output level control step are utilized even when the chain reproduction is performed. Therefore, a next rhythm pattern can immediately be reproduced before reproduction of all the sound sources for a rhythm pattern in execution is finished, so that it is possible to solve the problem in the conventional technology that a next rhythm pattern can not be reproduced until a rhythm pattern in execution is completely finished.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A sound signal adding apparatus in which there is a limitation on the number of reproducible sound generators and which reproduces an additional sound data within these limited number of sound generator; said apparatus comprising:

a sound data searching unit for checking, the remaining reproduction time of each of the sound data currently being reproduced when the additional sound data is to be reproduced, and searching a sound data having the least reproduction time remaining; and an output level control unit for controlling the output level of the sound signal corresponding to the sound data having the least reproduction time remaining in such a way that the output level is reduced step by step based on the result of checking by said sound data searching unit.

2. A sound signal adding apparatus according to claim 1; wherein, when a chain reproduction in which a particular rhythm pattern in reproduction using a plurality of sound generators is linked to a rhythm pattern different therefrom or to the same rhythm pattern is performed, said sound data searching unit detects a sound data having the least reproduction time remaining, and said output level control unit reduces the output level of the sound signals in order from the sound data having the least reproduction time remaining step by step in order to reproduce the next rhythm pattern.

3. A sound reproduction method in which there is a limitation on the number of reproducible sound generators and which reproduces an additional sound data within these limited number of sound generator; said method comprising:

a sound data searching step of checking, the remaining reproduction time of each of the sound data currently being reproduced when the additional sound data is to be reproduced, and searching a sound data having the least reproduction time remaining; and an output level controlling step of controlling the output level of the sound signal corresponding to the sound data having the least reproduction time remaining in such a way that the output level is reduced step by step based on the result of checking in said sound data searching step.

4. A sound source reproduction method according to claim 3; wherein, when a chain reproduction in which a particular rhythm pattern in reproduction using a plurality of sound generators is linked to a rhythm pattern different therefrom or to the same rhythm pattern is performed, by successively searching sound data having the least reproduction time remaining in said sound data searching step, and reducing the output level of the sound signal in order from sound source data having the least reproduction time remaining step by step in said output level control step in order to reproduce the next rhythm pattern.

* * * * *